US008478586B2

(12) United States Patent
Honma

(10) Patent No.: US 8,478,586 B2
(45) Date of Patent: Jul. 2, 2013

(54) SIGNAL PROCESSING APPARATUS AND METHOD, AND PROGRAM

(75) Inventor: Hiroyuki Honma, Chiba (JP)

(73) Assignee: Sony Corporation, Tokyo (JP)

( * ) Notice: Subject to any disclaimer, the term of this patent is extended or adjusted under 35 U.S.C. 154(b) by 981 days.

(21) Appl. No.: 12/524,783

(22) PCT Filed: Jun. 26, 2008

(86) PCT No.: PCT/JP2008/061613

§ 371 (c)(1),
(2), (4) Date: Jul. 28, 2009

(87) PCT Pub. No.: WO2009/016901

PCT Pub. Date: Feb. 5, 2009

(65) Prior Publication Data

US 2010/0106494 A1 Apr. 29, 2010

(30) Foreign Application Priority Data

Jul. 30, 2007 (JP) ..... 2007-197959

(51) Int. Cl.
*G10L 19/04* (2006.01)

(52) U.S. Cl.
USPC ..... 704/224; 704/219; 704/229; 704/225; 704/205; 375/299; 375/340; 375/341; 375/232; 381/56

(58) Field of Classification Search
USPC ..... 704/219, 500–504, 224, 229, 230, 704/225, 205, 222; 375/299, 340, 341, 266, 375/343, 232, 230; 381/56
See application file for complete search history.

(56) References Cited

U.S. PATENT DOCUMENTS

| | | | | |
|---|---|---|---|---|
| 5,717,821 | A | 2/1998 | Tsutsui et al. | |
| 6,169,973 | B1 * | 1/2001 | Tsutsui et al. | 704/500 |
| 6,366,545 | B2 | 4/2002 | Koyata | |
| 6,658,382 | B1 * | 12/2003 | Iwakami et al. | 704/224 |
| 6,871,106 | B1 * | 3/2005 | Ishikawa et al. | 700/94 |
| 7,595,819 | B2 * | 9/2009 | Kondo | 348/222.1 |
| 7,860,194 | B2 * | 12/2010 | Kim et al. | 375/341 |
| 8,290,784 | B2 * | 10/2012 | Honma | 704/501 |

(Continued)

FOREIGN PATENT DOCUMENTS

| | | |
|---|---|---|
| EP | 0 920 127 | 6/1999 |
| JP | 3336617 | 8/2002 |
| JP | 3879249 | 11/2006 |
| JP | 3879250 | 11/2006 |

OTHER PUBLICATIONS

English-language European Search Report in corresponding EP 08 79 0628, mailed Jun. 29, 2012.

*Primary Examiner* — Vijay B Chawan
(74) *Attorney, Agent, or Firm* — Finnegan, Henderson, Farabow, Garrett & Dunner, L.L.P.

(57) ABSTRACT

A coded code string from an input terminal 110 is demultiplexed by a demultiplexer circuit 101, normalization coefficient information in the code string is sent to a normalization coefficient information increasing/decreasing circuit 102, addition or subtraction of a positive value is performed, and level adjustment of a signal is performed. A normalization coefficient information cutoff amount calculating circuit 103 calculates the cutoff amount for a case where the subtraction amount of normalization coefficient information is larger than normalization coefficient information and normalization coefficient information after subtraction is cut off at the minimum possible value. A gain control function generation information modifying circuit 104 modifies gain control function generation information according to the cutoff amount.

10 Claims, 10 Drawing Sheets

U.S. PATENT DOCUMENTS

2001/0021152 A1 9/2001 Koyata
2002/0010577 A1* 1/2002 Matsumoto et al. ..... 704/219
2002/0013703 A1* 1/2002 Matsumoto et al. ..... 704/234
2004/0196770 A1* 10/2004 Touyama et al. ..... 369/59.11
2004/0250287 A1* 12/2004 Haneda et al. ..... 725/93
2005/0091051 A1* 4/2005 Moriya et al. ..... 704/229
2005/0163323 A1* 7/2005 Oshikiri ..... 381/22
2007/0282603 A1* 12/2007 Bessette ..... 704/219

* cited by examiner

| Glev | Gain(Glev) |
|---|---|
| 0 | 0.0625 |
| 1 | 0.1250 |
| 2 | 0.2500 |
| 3 | 0.5000 |
| 4 | 1.0000 |
| ... | ... |
| 14 | 1024 |
| 15 | 2048 |

FIG.7
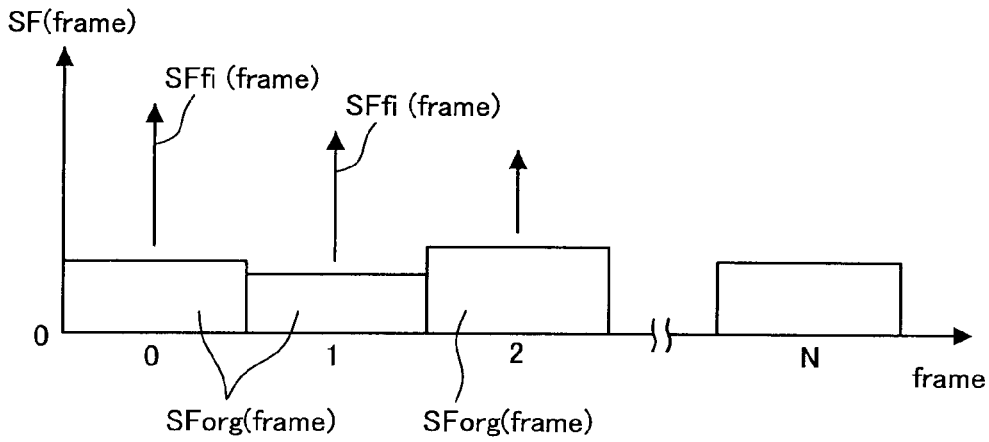
FIG.8
| frame | 0 | 1 | 2 | ・・・ | N |
|---|---|---|---|---|---|
| SForg (frame) | 27 | 25 | 32 | ・・・ | 25 |
| SFfi (frame) | 40 | 30 | 20 | ・・・ | 0 |
| SForg + SFfi | 67 | 55 | 52 | ・・・ | 25 |
| Tsf | 4 | 0 | 0 | ・・・ | 0 |
FIG.9
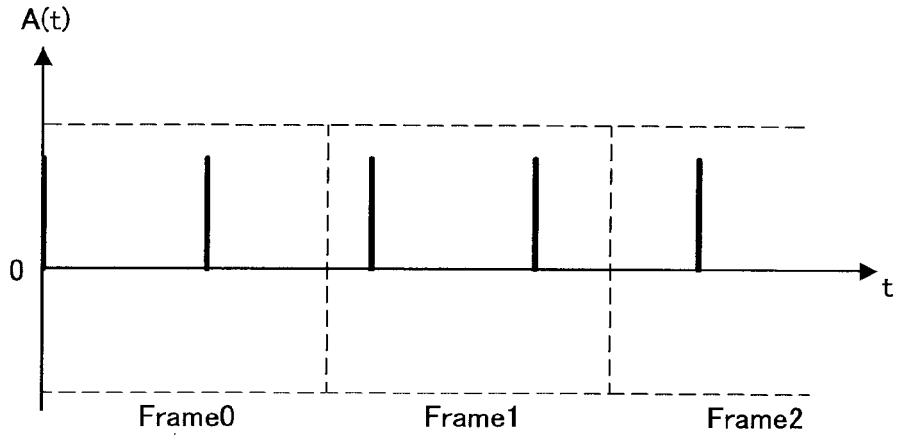

| SF | SFval (SF) |
|---|---|
| 0 | 0.031250 |
| 1 | 0.039373 |
| 2 | 0.049606 |
| 3 | 0.062500 |
| ··· | ··· |
| 62 | 52016 |
| 63 | 65536 |

SFval (SF) = 2^(SF/3−5)

| frame | 0 | 1 | 2 | ··· | N |
|---|---|---|---|---|---|
| SForg (frame) | 17 | 15 | 22 | ··· | 15 |
| SFfi (frame) | 40 | 30 | 20 | ··· | 0 |
| SForg − SFfi | −23 | −15 | 2 | ··· | 15 |
| Tsf | 23 | 15 | 0 | ··· | 0 |

SFm (frame) = SForg (frame)−SFfi (frame)
if SFm (frame) < 0, then SFm (frame) = 0

SIGNAL PROCESSING APPARATUS AND METHOD, AND PROGRAM

TECHNICAL FIELD

The present invention relates to a signal processing apparatus and a signal processing method, and a program, and more particularly, to a signal processing apparatus and a signal processing method, and a program which are suitable for use in a case of increasing/decreasing volume without decoding a code string.

BACKGROUND ART

High efficiency coding of audio signal allows for the realization of a sound in high quality, for example, even when data amount is reduced to approximately 1/10 to 1/20 that of a CD (Compact Disk), by using the mechanism of human hearing (hearing characteristics and the like). Currently, products using such technologies are distributed in the marketplace, thereby allowing for such as recording on a smaller recording medium and delivering via a network.

One of the major hearing characteristics used in such high efficiency coding of audio signal is simultaneous and temporal masking.

Simultaneous masking is a hearing characteristic that, in a case where sounds at different frequencies exist at the same time, when there is a small-amplitude sound in the neighborhood of the frequency of a large-amplitude sound, the small-amplitude sound is masked and becomes hard to perceive.

On the other hand, temporal masking is a masking effect in the temporal direction, and a hearing characteristic that, for example, a small-amplitude sound existing at a time before or after a large-amplitude sound is masked to be hard to perceive.

There are two phenomena for the temporal masking: forward masking where temporally-before generated sounds mask temporally-after generated sounds; and backward masking where a temporally-after generated sounds mask temporally-before generated sounds.

It is known that forward masking is effective for a period in the order of several tens of msec (milliseconds) while backward masking is effective for an extremely short period of approximately 1 msec.

In a typical high efficiency coding method for audio, after orthogonal transformation of time signals by MDCT (Modified Discrete Cosine Transform), normalization is performed on the obtained MDCT coefficients on the frequency axis for each set of a plurality of MDCT coefficients, and then, quantization and coding are performed. Here, for advantageous use of the above-described hearing characteristics, signals are efficiently compressed by adaptively changing the number of steps in quantization for each set of MDCT coefficients and controlling the generation of quantization noise.

The transformation length of the above MDCT is set to be approximately 20 to 40 msec considering such as the time for simultaneous masking to work effectively. However, in a case of non-stationary signals which have sharp attacks, such as made by a pair of castanets, the generated quantization noise (quantization errors) are uniformly distributed in a frame after inverse MDCT transformation. FIGS. 9 and 10 show such situation.

In MDCT for a practical coding apparatus, adjacent frames are used, partially overlapped to each other. However, for the sake of simplicity, it is assumed that there is no overlap between the frames, and the explanation will be made in a more general manner.

A signal on the time axis shown in FIG. 10 is obtained by coding by the above-described method on an input signal on the time axis as shown in FIG. 9, i.e., an input signal with pulse-like attacks, and decoding the obtained code string. As is apparent from FIG. 10, the quantization noise (quantization error) shown in the shaded area in the figure is uniformly distributed along the time axis in the frame. Besides, "Frame" in FIGS. 9 and 10 indicate a frame of a MDCT transformation length, and is likewise in the following FIGS. 11-13.

Regarding the so generated noise, generally, noise generated temporally before the attacks is called pre-echo noise; on the other hand, noise generated temporally after the attacks is called post-echo noise.

The period during which the above-described temporal masking auditory masks the pre-echo noise and post-echo noise is extremely short, and thus, such cannot be prevented by the above-described MDCT transformation length of 20 to 40 msec. A general high efficiency coding method for audio tries various measures to limit such noise to a period during which temporal masking is effective.

For example, MPEG1 Audio Layer III (MPEG: Moving Picture Experts Group), a so-called MP3, takes measures to suppress pre/post-echo noise by generating a subband signal by decomposing an input PCM signal into equal subbands with a subband filter bank, and then, appropriately selecting from MDCT transformation lengths of two different lengths depending on the stationarity of the signal. For example, when a non-stationary signal having a sharp attack is input, by selecting a short MDCT transformation length, the period during which pre/post-echo noise is generated is limited to be within a short MDCT frame and noise is prevented from being perceived.

On the other hand, as disclosed in Patent Document 1, a coding method used in a so-called MD (MiniDisc™) and the like takes measures to suppress pre/post-echo noise by generating a subband signal by decomposing an input PCM signal into equal subbands with a subband filter bank, then, performing gain control of changing, along the time axis, the gain of the subband signal depending on the stationarity of the signal to make it a stationary subband signal, and then, performing MDCT of a fixed transformation length and performing normalization/quantization/coding.

FIGS. 11, 12 and 13 are diagrams for explaining the effect of gain control. Incidentally, in the above-described Patent Document 1, an explanation is made with adjacent frames partially overlapped. However, herein, an explanation is made in a more general manner where there is no overlap between the frames.

First, a coding apparatus obtains gain control functions, such as G_0($t$), G_1($t$), G_2($t$) of FIG. 11, for the input signal of FIG. 9.

The gain control function corresponds to that obtained by further equally subdividing each frame along the time axis into subframes, obtaining the maximum amplitude or power within these subframes, and interpolating the obtained maximum amplitude or power with a linear function or the like. The input signal is first made into an approximately flat signal in the temporal direction by multiplying the input signal by the gain control function, amplifying the small amplitude portion and attenuating the large amplitude portion; and the signal is then normalized, quantized and coded, and multiplexed along with gain function generation information and normalization information, thereby a code string is obtained.

A decoding apparatus sequentially performs demultiplexing (process inverse to multiplexing), decoding, dequantization, and denormalization (process inverse to normalization) on the input code string. A signal on the time axis obtained by the processes so far is as shown in FIG. 12, and the quantization error shown in the shaded area in FIG. 12 is uniformly distributed in the entire frame. Here, a waveform as shown in FIG. 13 is obtained by reconstructing an inverse gain control function (function with the value of the gain control function inversed) that is a counterpart of the gain control function of FIG. 11 from the gain control function generation information obtained by demultiplexing the above-described code string and multiplying the waveform of FIG. 12 by the inverse gain control function.

As is apparent from FIG. 13, the quantization error shown in the shaded area in the figure is distributed in such a way that, compared to the level in the vicinity of before and after a pulse which is an attack portion, the level is attenuated in the other portions, and due to the effect of temporal masking, pre-echo noise and post-echo noise can be considerably suppressed. The gain control itself is within optimization of coding algorithm of the coding apparatus, and various settings are possible according to the circuit size and application of the coding apparatus, such as, if bits are allocated abundantly and the generation of quantization error is extremely small, gain control is not performed on an input signal with a large attack, for example.

As such, with a high efficiency coding of audio, by appropriately controlling the generation of quantization noise according to the property of a signal by making better use of hearing characteristics, it becomes possible to efficiently compress a signal.

Meanwhile, in such high efficiency coding technology for audio signal, since relatively large computation amount and memory are needed at the time of coding/decoding, a technology of first performing a simple signal processing on a coded code string is being proposed. This is a technology that performs a desired signal processing with small amount of computation and small memory by directly changing the parameter or the like included in a code string without performing a process of performing a desired signal processing on a code string after decoding the code string to a signal on the time axis and then re-coding the signal.

For example, Patent Document 2 discloses a technology making the filtering of a signal possible by directly changing normalization coefficient information in a code string. Also, Patent Document 3 discloses a technology making level adjustment of a signal possible by directly changing normalization coefficient information in a code string.

[Patent Document 1] Japan Patent No. 3263881
[Patent Document 2] Japan Patent No. 3879249
[Patent Document 3] Japan Patent No. 3879250

DISCLOSURE OF THE INVENTION

Problems to be Solved by the Invention

Meanwhile, with a high efficiency coding method for audio adopting the above-described gain control technology, when the technologies described in the above-described Patent Documents 2 and 3 are directly applied, problems may arise depending on the property of signal. Hereunder, the problems will be explained with reference to the drawings.

For example, it is assumed that, in a case where a code string is obtained by coding a pulse-like signal as shown in FIG. 9 by the high efficiency coding method for audio adopting the above-described gain control technology, it is desired to obtain the effect of fade-in by directly changing normalization information in the code string by using the above-described Patent Document 3 and performing level adjustment of the code string.

The result of performing a signal processing after a decoding apparatus decodes a code string and obtains an output PCM signal is as shown in FIG. 14.

This is the result of multiplying the output PCM signal of the decoding apparatus by a fade-in function Fi(t) that gradually increases along with time within the range of 0 to 1.0.

When expressing the shape of the fade-in function Fi(t) with the subtraction of normalization coefficient information for each frame by using the technology described in the above-described Patent Document 3, it is as shown in FIG. 15. SFfi(frame) in FIG. 15 corresponds to that obtained by resampling Fi(t) which is a function of a discrete time at intervals of the frame size and expressing the value with a positive integer as a difference value of normalization coefficient information.

In the case of the high efficiency coding method for audio described in the above-described Patent Document 1, the above-described normalization coefficient information is expressed in 6-bit 2 decibel step as shown in FIG. 16. In FIG. 16, SF is normalization coefficient information which is a positive integer, and SFval(SF) is a normalization coefficient which is a positive real number.

FIG. 17 shows a processing realizing a fade-in by subtracting normalization coefficient information based on the technology described in the above-described Patent Document 3. In this technology, normalization coefficient is for normalizing an MDCT coefficient in a frequency domain, and is obtained for each unit called a quantization unit, which is a collection of a plurality of MDCT coefficients. However, herein, for the sake of simplicity, the explanation is made based on a single normalization coefficient.

SForg(frame) in FIG. 17 indicates normalization coefficient information obtained for each frame.

Here, with regard to the frame with frame number 2, it is a frame on which gain control is not performed due to the factors such as relation in locations of windows in MDCT and pulses, and algorithm for gain control.

To the contrary, when performing subtraction of normalization coefficient information by using SFfi (frame) explained in FIG. 15, it is as shown in FIG. 18. Since normalization coefficient information is a positive integer between 0 and 63, when normalization coefficient information becomes negative as a result of subtraction, it is cut off at 0. Tsf indicates the amount of normalization coefficient information that is cut off.

FIG. 19 indicates a result including frames where the above-described subtraction result of normalization coefficient information becomes negative and normalization coefficient information is cut off at 0.

SFm(frame) of FIG. 19 indicates normalization coefficient information on which a fade-in processing has been performed.

FIG. 20A shows a PCM signal on which a fade-in processing has been applied, where the PCM signal has been obtained by decoding the same code string as that of FIG. 14, and FIG. 20B shows an output PCM signal obtained by inputting to a decoding apparatus a code string on which the above-described fade-in processing on code strings has been performed. In frames with frame numbers 0 and 1, the normalization coefficient is cut off and then inverse gain control is performed, and as a result, the pulse signal is larger compared to that of FIG. 20A. On the other hand, in frame number 2, gain control is not performed and the normalization coefficient is not cut off, and thus, an amplitude value corresponds to the pulse signal of FIG. 20A.

The present invention has been attained in view of such circumstances, and has its object to provide a signal processing apparatus, a method, and a program capable of solving the problem that arises when directly processing a code string coded by a high efficiency coding method for audio that uses gain control and applying signal processing such as fade-in, fade-out or the like, and of outputting a high-quality code string.

Means for Solving the Problems

To solve the above-described problem, the present invention may, in signal processing performed on a code string obtained by dividing an input digital signal into blocks along the time axis, performing gain control along the time axis for each block, performing normalization of the gain-controlled signal component by using a positive value, quantizing the normalized signal component, and performing coding and multiplexing along with gain control function generation information generating a gain control function for performing the gain control and normalization coefficient information, perform level adjustment of the signal for the coded code string by adding or subtracting an integer value to/from normalization coefficient information in the code string, and at the same time, for a case where the subtraction amount of the normalization coefficient information is larger than the normalization coefficient information and the normalization coefficient information after subtraction is cut off at the minimum possible value, modify the gain control function generation information according to the cutoff amount.

Here, for a case where the addition amount of normalization coefficient information is large and normalization coefficient information after addition is cut off at the maximum possible value, the gain control function generation information may be modified according to the cutoff amount.

Effect of the Invention

According to the present invention, when directly processing a code string and applying signal processing such as fade-in, fade-out or the like, it is possible to suppress the amplification of a signal occurred by the cutoff of normalization coefficient information and inverse gain control by appropriately rewriting gain control information according to the cutoff amount of normalization coefficient information, and to output a code string on which a desired signal processing has been performed.

BRIEF DESCRIPTION OF THE DRAWINGS

FIG. 7 is a diagram for explaining a result of addition of normalization coefficient information and the corresponding cutoff of normalization coefficient information.

FIG. 8 is a diagram showing a concrete example of cutoff of normalization coefficient information.

FIG. 9 is a diagram showing a pulse signal of a constant cycle and a constant amplitude.

EXPLANATION OF NUMERALS

101 demultiplexer circuit
102 normalization coefficient information increasing/decreasing circuit
103 normalization coefficient information cutoff amount calculating circuit
104 gain control function generation information modifying circuit
105 multiplexer circuit

BEST MODE FOR CARRYING OUT THE INVENTION

Hereunder, a concrete embodiment to which the present invention is applied will be explained in detail with reference to the drawings.

Figure 1:
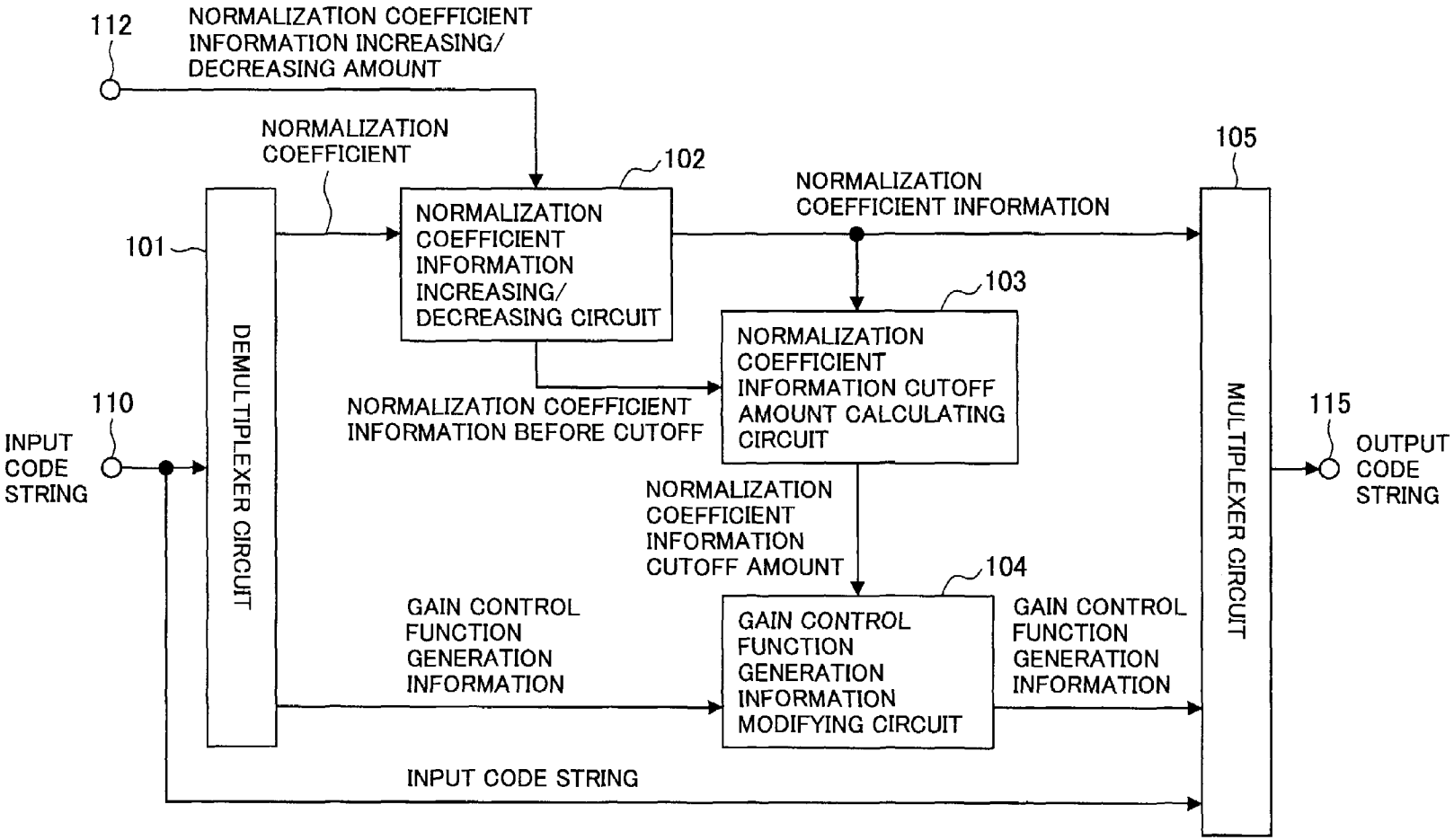
FIG. 1 is a block diagram showing a schematic configuration of a signal processing apparatus that is an embodiment of the present invention.

FIG. 1 is a block diagram schematically showing a configuration of a signal processing apparatus that is used in an embodiment of the present invention.

The signal processing apparatus shown in FIG. 1 is configured by having a demultiplexer circuit 101, a normalization coefficient information increasing/decreasing circuit 102 (normalization coefficient information increasing/decreasing means), a normalization coefficient information cutoff amount calculating circuit 103 (cutoff amount calculating means), a gain control function generation information modifying circuit 104 (modifying means for gain control function generation information), and a multiplexer circuit 105.

The demultiplexer circuit 101 demultiplexes a code string input from an input terminal 110, supplies normalization coefficient information to the normalization coefficient information increasing/decreasing circuit 102, and supplies gain control function generation information to the gain control function generation information modifying circuit 104. An example of the code string input from the input terminal 110 to the demultiplexer circuit 101 will be described later.

The normalization coefficient information increasing/decreasing circuit 102 increases or decreases normalization coefficient information based on normalization coefficient information increasing/decreasing amount given from an input terminal 112, and when, as a result of calculation, upper possible limit or lower possible limit of normalization coefficient information is exceeded, each is replaced by the upper limit or the lower limit. Normalization coefficient information, which is an output, is supplied to the gain control function generation information modifying circuit 104 and the multiplexer circuit 105.

The normalization coefficient information before being replaced by the upper limit/lower limit is supplied as before-cutoff normalization coefficient information to the normalization coefficient information cutoff amount calculating circuit 103.

Figures 16, 17, 18:
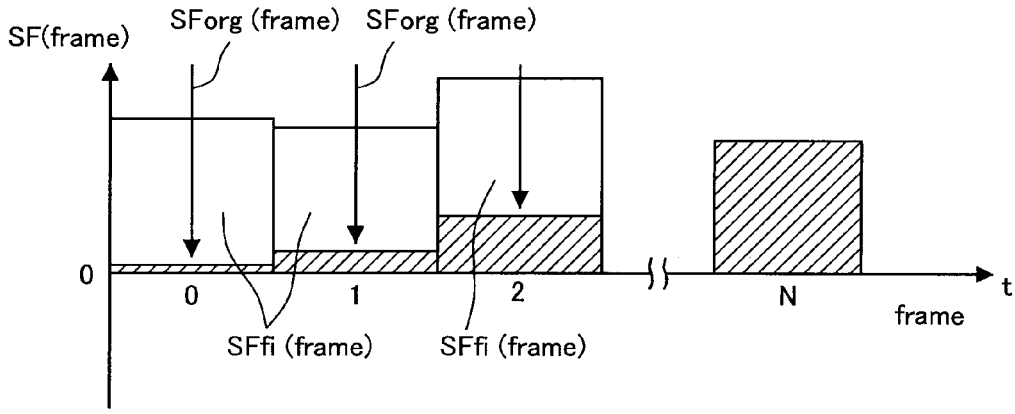
FIG. 16 is a diagram showing an example of a 6-bit normalization coefficient table.
FIG. 17 is a diagram showing a result of subtraction of normalization coefficient information and the corresponding cutoff of normalization coefficient information.
FIG. 18 is a diagram showing a concrete example of cutoff of normalization coefficient information.

As for the increasing/decreasing of normalization coefficient information here, a method described along with FIG. 17 as described above can be used.

The normalization coefficient information cutoff amount calculating circuit 103 compares normalization coefficient information output from the normalization coefficient information increasing/decreasing circuit 102 and normalization coefficient information before cutoff output likewise from the normalization coefficient information increasing/decreasing circuit 102, and calculates the normalization coefficient information cutoff amount to supply to the gain control function generation information modifying circuit 104.

Figure 19:
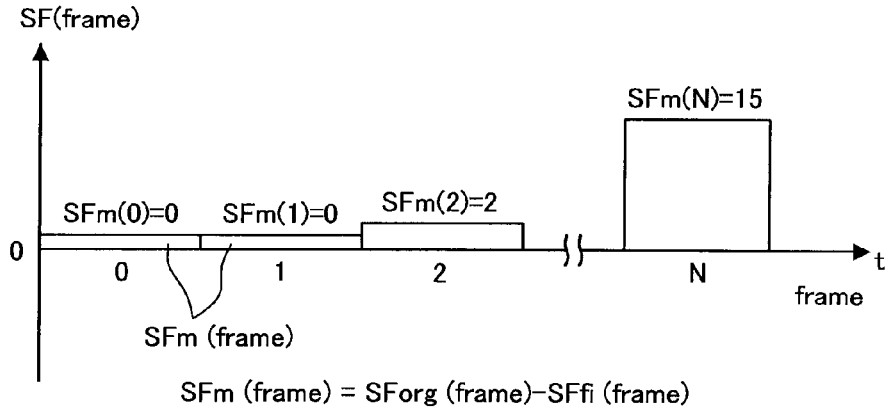
FIG. 19 is a diagram showing a result of subtraction of normalization coefficient information and the corresponding cutoff of normalization coefficient information.
Figure 20A:
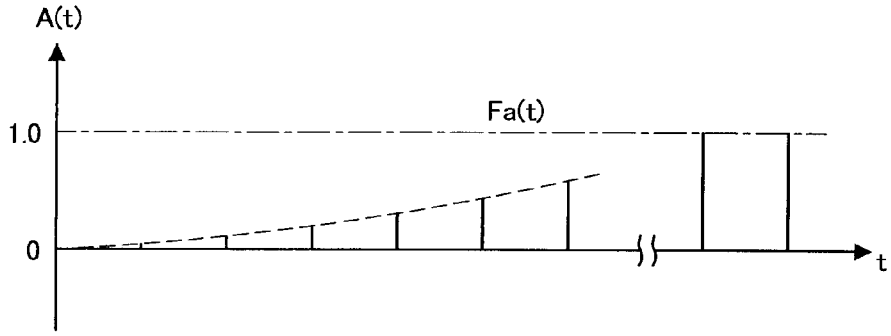
FIG. 20A is a diagram showing how a signal is amplified depending on the relation between cutoff of normalization coefficient information and inverse gain control.
Figure 20B:
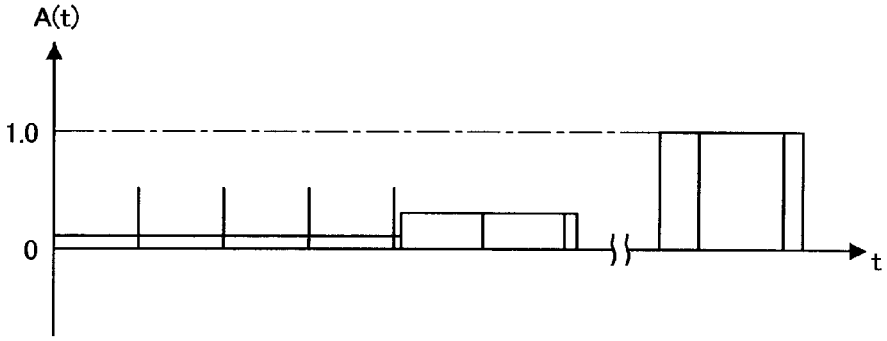
FIG. 20B is a diagram showing how a signal is amplified depending on the relation between cutoff of normalization coefficient information and inverse gain control.

As for the calculation of normalization coefficient information cutoff amount here, a method described along with FIGS. 18 and 19 as described above can be used.

The gain control information modifying circuit 104 compares gain control function generation information output from the demultiplexer circuit 101 and normalization coefficient information cutoff amount output from the normalization coefficient information cutoff amount calculating circuit 103, obtains gain control function generation information modification amount, and modifies gain control function generation information. Detailed operation and the like of the gain control function generation information modifying circuit 104 will be described later.

The modified gain control function generation information is supplied to the multiplexer circuit 105.

The multiplexer circuit 105 has, as inputs, normalization coefficient information output from the normalization coefficient information increasing/decreasing circuit 102, gain control function generation information output from the gain control information modifying circuit 104 and an input code string from the input terminal 110, replaces corresponding parts of the input code string with normalization coefficient information and gain control function generation information, each newly obtained from the normalization coefficient information increasing/decreasing circuit 102 and the gain control information modifying circuit 104, performs multiplexing, and outputs an output code string from an output terminal 115.

Here, an example of the code string described above which is to be an input to the demultiplexer circuit 101 will be explained using FIG. 2.

Figures 2, 3:
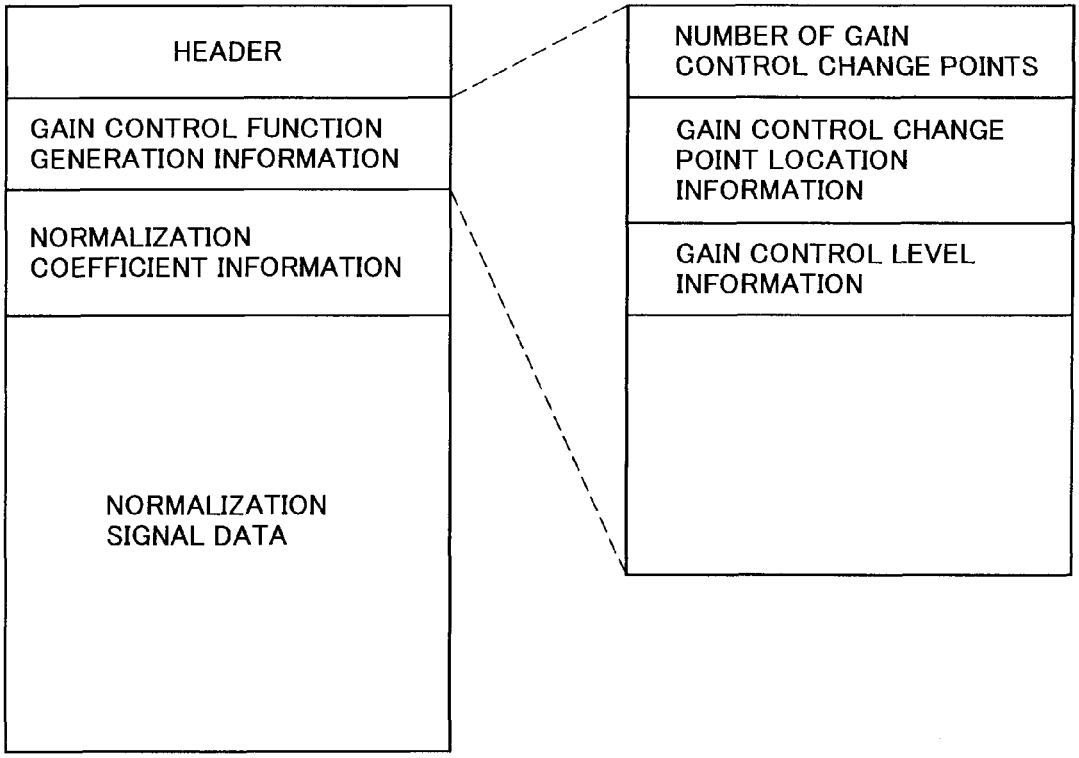
FIG. 2 is a diagram showing an example of the format of a code string of a coding method of the embodiment of the present invention.
FIG. 3 is a diagram showing an example of a 4-bit gain control level information table of the embodiment of the present invention.

FIG. 2 shows one of the frames configuring the above-described code string, and is configured by a header, gain control function generation information, normalization coefficient information and normalization signal data.

Gain control function generation information is configured by the number of gain control change points, gain control change point location information and gain control level information, and the numbers of pieces of gain control change point location information and gain control level information are determined based on the number of gain control change points.

Gain control level information Glev is, for example, a 4-bit code as in FIG. 3, and its gain control level Gain is obtained by the following equation as the function of Glev.

$$\mathrm{Gain}(Glev)=2^{\wedge}(Glev-4)$$

Figure 4A:
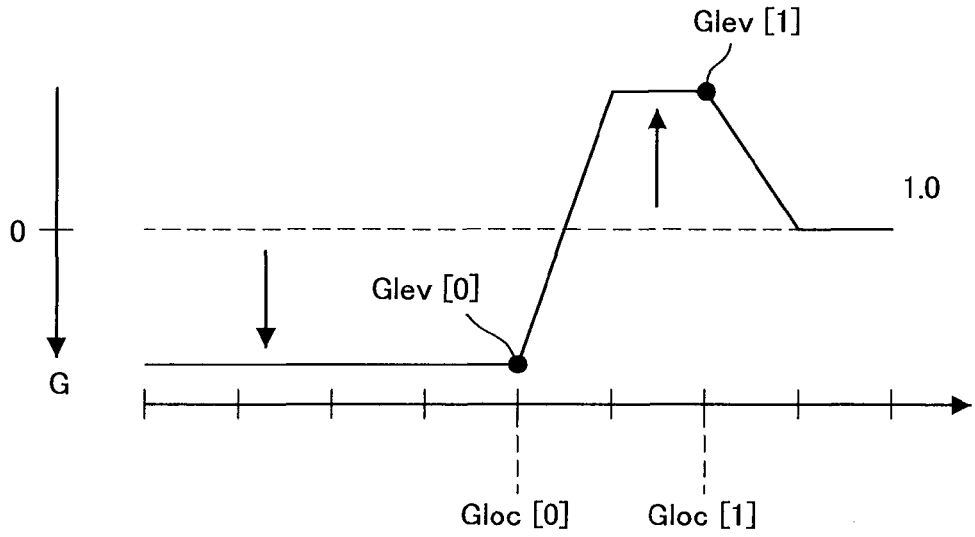
FIG. 4A is a diagram showing a concrete example of an inverse gain control function of the embodiment of the present invention.
Figure 4B:
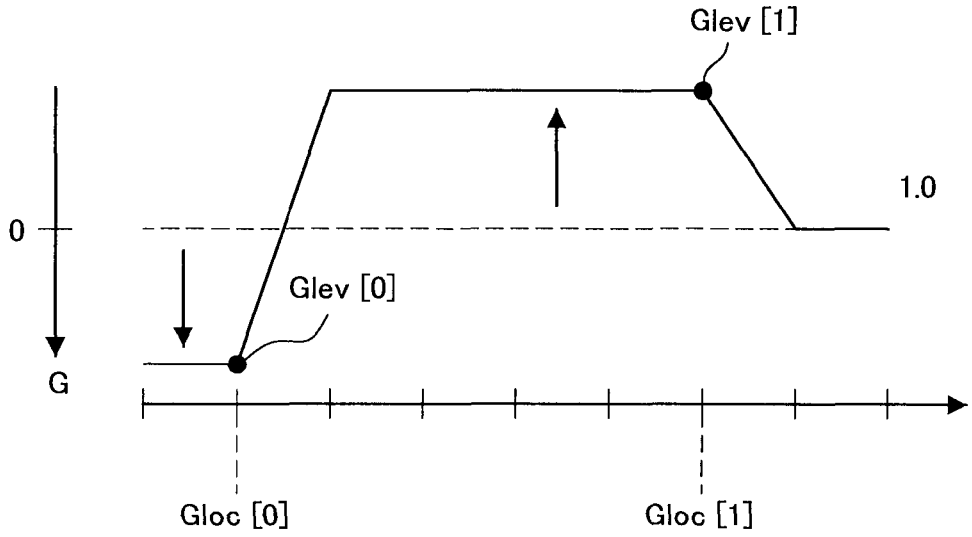
FIG. 4B is a diagram showing a concrete example of an inverse gain control function of the embodiment of the present invention.

Concrete examples of an inverse gain control function generated by a decoder based on gain control function generation information of FIG. 2 are shown in FIGS. 4A and 4B.

In FIG. 4A, the number of the gain control change points is two, and two pieces of gain control change point location information are respectively shown as Gloc[0] and Gloc[1] and two pieces of gain control level information are respectively shown as Glev[0] and Glev[1].

Gain control change point location information Gloc indicates the locations of subframes into which a frame is uniformly subdivided, and as shown in FIG. 4, the gain control level information at Gloc[0] corresponds to Glev[0]. Further, gain control level information at the location of a subframe before a subframe with gain control change point location information Gloc is the gain control level information of the next subframe with Gloc immediately after the above subframe with Gloc.

Further, as shown in FIG. 4, the gain control level of the subframe at the end of the frame is 1.0.

Further, the inverse gain control function in FIG. 4 is relationally inverse to the gain control level information of the 4-bit code shown in FIG. 3, and, for example, 0.5 of Gain(3) is gain change of 2.0 times by the inverse gain control function.

With the gain control function in FIG. 4, gain control levels of respective subframes are interpolated by a straight line. However, as another embodiment according to the present invention, interpolation may be performed using a sine function or the like, or it is not necessary to perform interpolation.

Gain control function generation information in FIG. 2 is recorded in a format as explained above, and further, the normalization signal data in the same FIG. 2 corresponds to that obtained by dividing the input PCM signal by the above-described gain control function and then performing normalization by a normalization coefficient.

The schematic configuration of the signal processing apparatus that is the embodiment of the present invention and the method will be summarized as follows. That is, first, as a coding method for obtaining a code string on which signal processing is to be performed, a coding method is used that obtains a code string by, when coding an input PCM signal, performing gain control along the time axis for each time block, performing normalization of the gain-controlled signal component by using a positive value, quantizing the normalized signal component, and performing coding and multiplexing along with gain control function generation information generating a gain control function for performing the gain control and normalization coefficient information. When decoding such a coded string, a decoding method is used that obtains an output PCM signal by demultiplexing the above-described code string, decoding the coded signal component, performing dequantization, and then, performing denormalization by using the above-described normalization coefficient information, and performing inverse gain control by using an inverse gain control function that is a counterpart of the above-described gain control function by using the gain control function generation information. In the embodiment of the present invention, signal processing is performed on the code string coded by the coding method as described-above that adjusts the level of the signal by subtracting or adding an integer from/to normalization coefficient information in the above-described code string, and when the subtraction amount of normalization coefficient information described above is larger than normalization coefficient information and normalization coefficient information after subtraction is cut off at the minimum possible value, gain control function generation information is modified according to the cutoff amount.

According to such configuration of the embodiment of the present invention, when performing volume control with small calculation amount and memory usage for a code string obtained by the high efficiency coding method for audio that uses gain control by adjusting a normalization coefficient without decoding the code string, it becomes possible to suppress the excessive amplification of volume caused by the cutoff of the normalization coefficient and the inverse gain control by appropriately modifying gain control function generation information according to the cutoff amount of the normalization coefficient, and to perform a desired volume control.

In the explanation of the embodiment of the present invention, a code string is used that is obtained by performing gain control on an input PCM signal, and then, performing normalization and performing quantization and coding. However, as for another embodiment according to the present invention, a code string may be used that is obtained by, for example, using a subband dividing filter on an input PCM signal to obtain a subband signal, and then, performing gain control.

Further, as another embodiment according to the present invention, it is also applicable to a code string that is obtained by performing time-frequency conversion such as MDCT on a signal obtained by performing gain control, and performing normalization, quantization and coding on each of specific blocks of the obtained MDCT coefficients.

Next, the gain control function generation information modifying circuit 104 of the signal processing apparatus with the configuration of FIG. 1 described above will be described in detail in the following.

The gain control function generation information modifying circuit 104 is a circuit for preventing the occurrence of excessive amplification of a signal caused by the cutoff of normalization coefficient information and inverse gain control as described above. The steps of its particular operation will be explained with reference to the flow charts of FIGS. 5 and 6.

Figure 5:
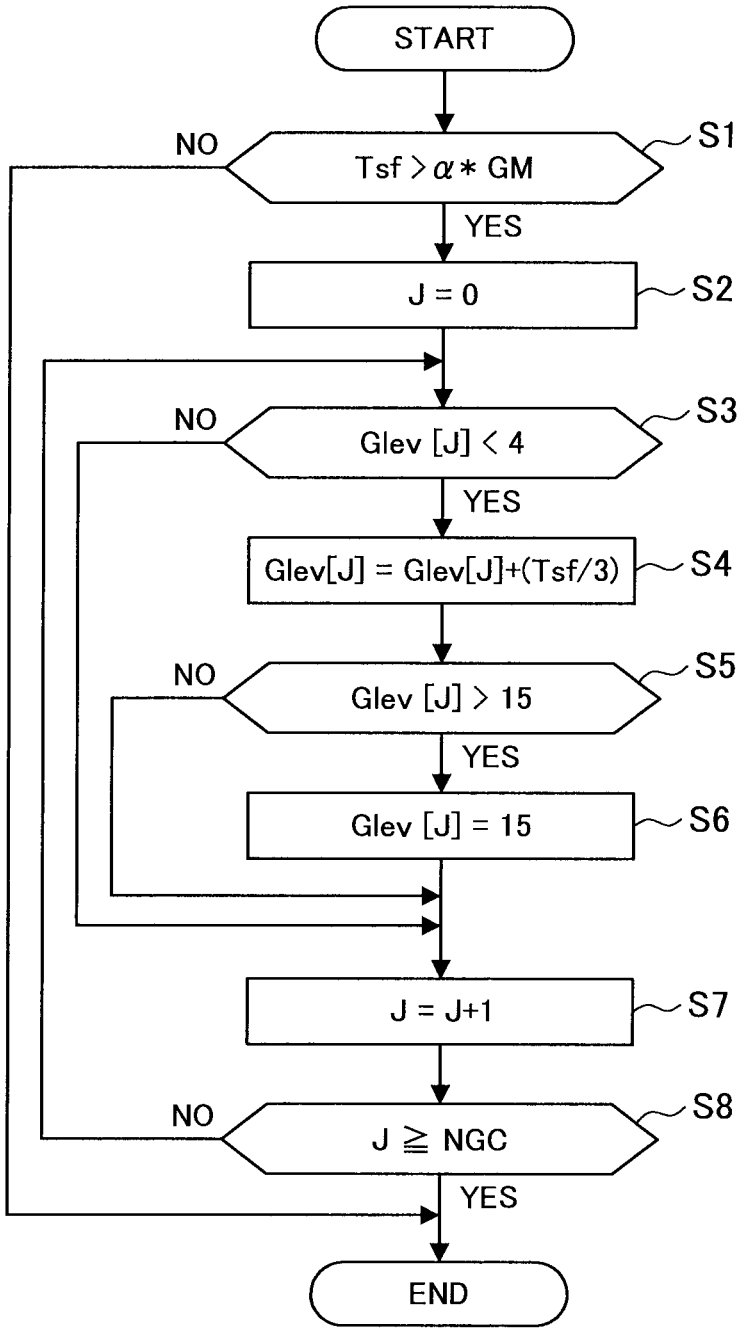
FIG. 5 is a flow chart for explaining an example of a processing step of a gain control function generation information modifying circuit of the embodiment of the present invention.

First, in step S1 of FIG. 5, it is determined whether or not it is necessary to modify gain control function generation information for a frame to be processed.

Tsf of step S1 is the cutoff amount of normalization coefficient information of the above-described FIG. 17, and is obtained as an output of the normalization coefficient information cutoff amount calculating circuit 103. GM is the amplification amount of gain for the whole frame occurring due to inverse gain control, and will be described in the explanation of FIG. 6. $\alpha$ is a constant number.

In the step S1, it is decided whether or not the cutoff amount Tsf of normalization coefficient information is larger than $\alpha \cdot GM$, and when it is judged YES (true), that is, when it is judged that the cutoff amount of normalization coefficient information is larger than the amplification amount of gain for the whole frame occurring due to inverse gain control, the process of step S2 is performed. When it is judged NO in step S1, the process is ended.

In step S2, J, a counter for the number of gain control change points, is initialized with 0, and afterwards, a loop process is performed NGC times, where NGC is the number of gain control change points, and the operation proceeds to step S3.

In step S3, judgment of whether or not gain control level information Glev[J] is less than 4, that is, a judgment process for a case of amplifying the gain for the inverse gain control function is performed.

When it is judged YES (Glev[J] is less than 4) in the step S3, the process of step S4 is performed, and when it is judged NO (Glev[J] is 4 or more), it proceeds to step S7. Note that, in step S7, a process of incrementing the counter J for the number of gain control change points (J=J+1) is performed.

In step S4, a suppression process for gain amplification is performed. To be more precise, the suppression process for gain amplification is performed by dividing the normalization coefficient information cutoff amount Tsf by 3 to make it a value corresponding to gain control level information and adding the same to gain control level information Glev[J] (Glev[J]=Glev[J]+Tsf/3). As is apparent from the above-described FIGS. 16 and 3, the normalization coefficient is a 2-dB step, and the gain control level is a value of a 6-dB step. After the process of step S4, it proceeds to step S5.

Next, in step S5 and step S6, cutoff of the calculation result of the above-described step S4 is performed. That is, in step S5, it is decided whether or not gain control level information Glev[J] after the process of step S4 exceeds the cutoff value of 15, and when 15 is exceeded, it proceeds to step S6 to make Glev[J] 15 and then proceeds to step S7 (increment process for counter J). When it is 15 or less, it directly proceeds to step S7.

This is performed so that Glev[J] does not exceeds its maximum possible value as a result of addition to gain control level information. As another example of the embodiment according to the present invention, the cutoff value may be made smaller than 15. Gain control is performed to suppress pre/post-echo noise, and gain control and inverse gain control respectively performed for coding and decoding are theoretically lossless processes. However, if the modification here for gain control level information becomes excessively large, the paired relation between gain control and inverse gain control is greatly disrupted.

Next, referring to the flow chart of FIG. 6, an explanation will be made for the calculation of an amplification amount GM of gain for the whole frame occurring due to inverse gain control.

Figure 6:
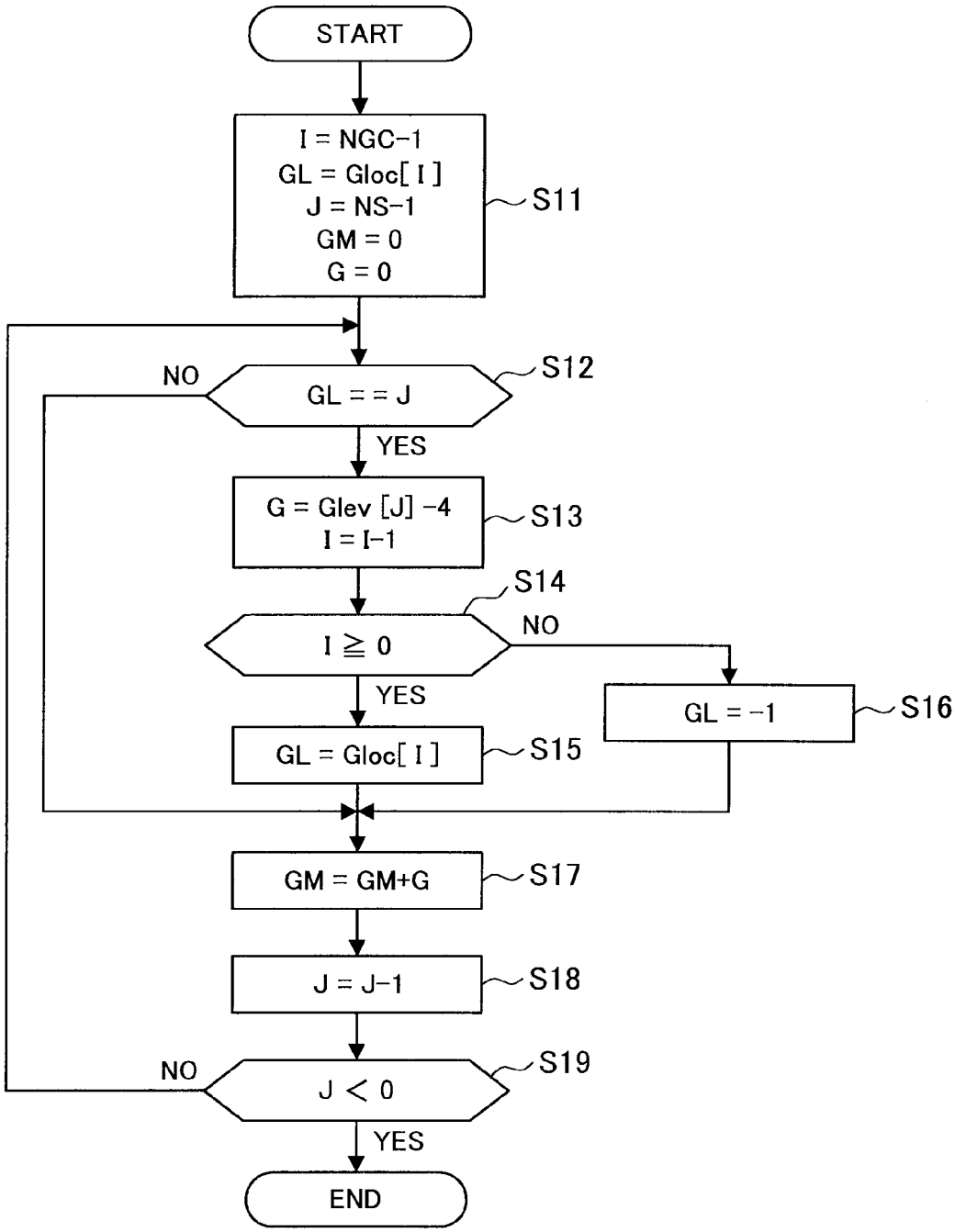
FIG. 6 is a flow chart for explaining an example of the calculation of an amplification amount GM of gain for the whole frame occurring due to inverse gain control of the embodiment of the present invention.
Figure 10:
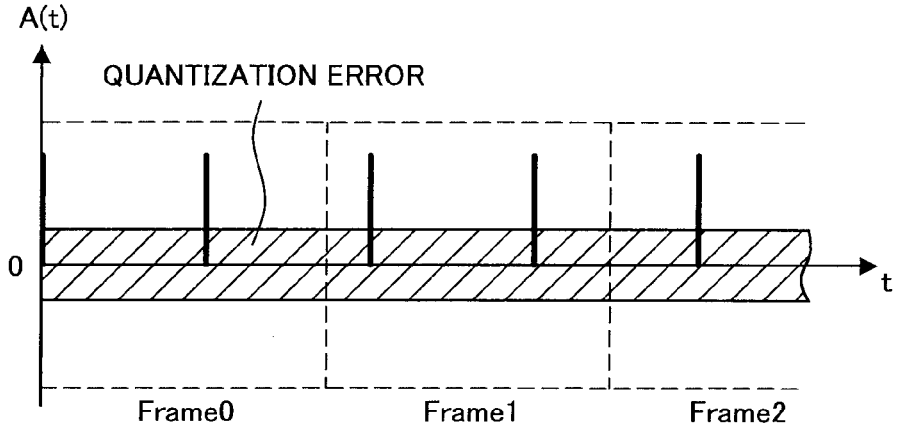
FIG. 10 is a diagram showing the generation of echo noise in a decoded signal in a general high efficiency coding for audio.
Figure 11:
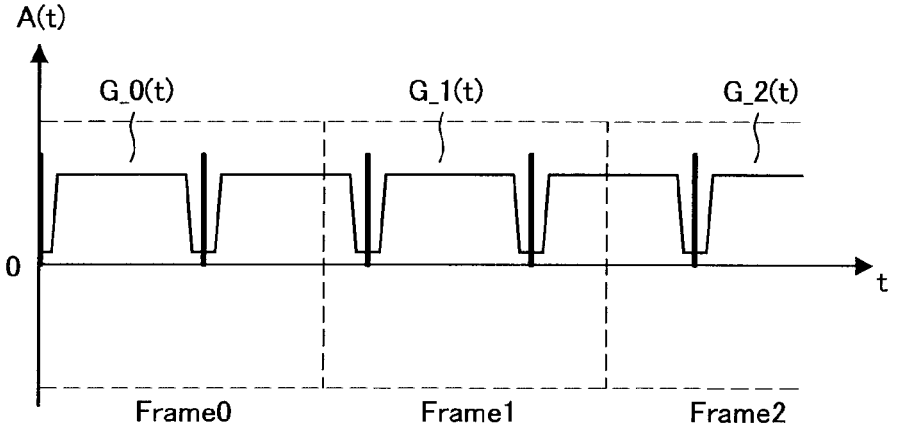
FIG. 11 is a diagram showing an example of a gain control function in a case where a pulse signal is input.
Figure 12:
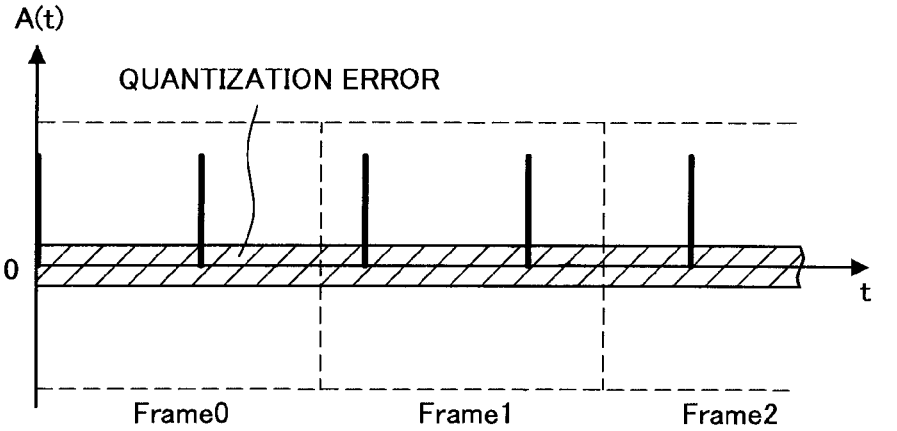
FIG. 12 is a diagram showing a state where quantization error is added to a gain-controlled signal.
Figure 13:
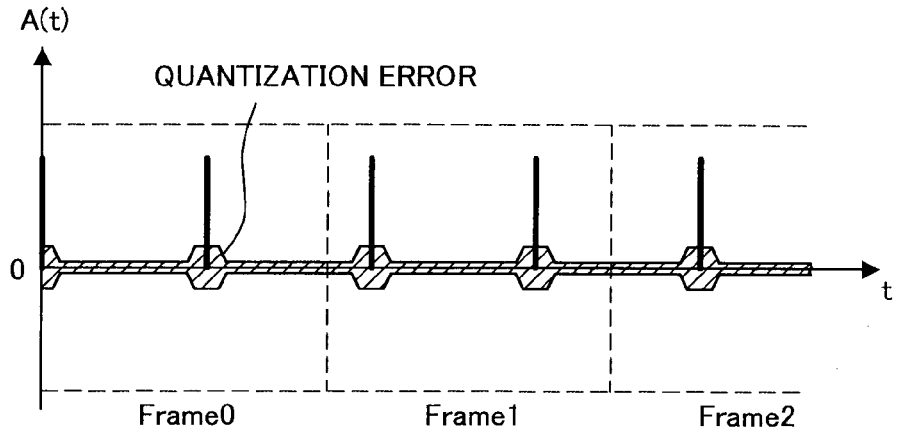
FIG. 13 is a diagram showing an effect of gain control for suppressing echo noise.
Figure 14:
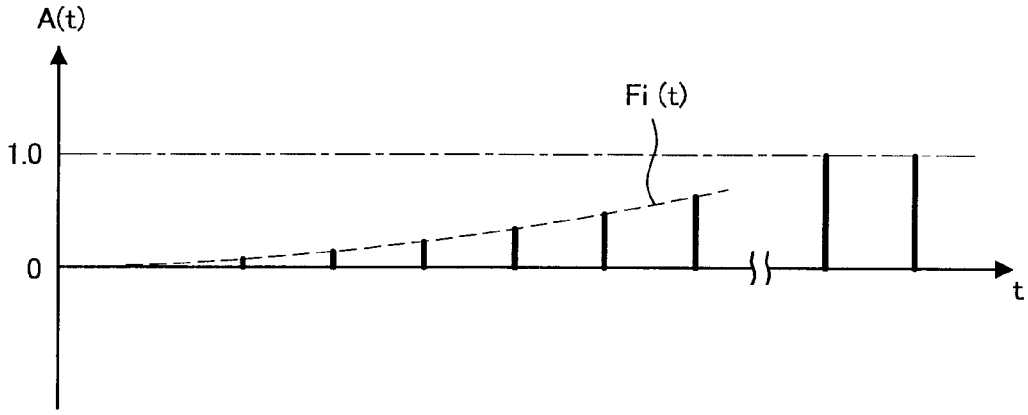
FIG. 14 is a diagram showing a function performing fade-in for each time sample.
Figure 15:
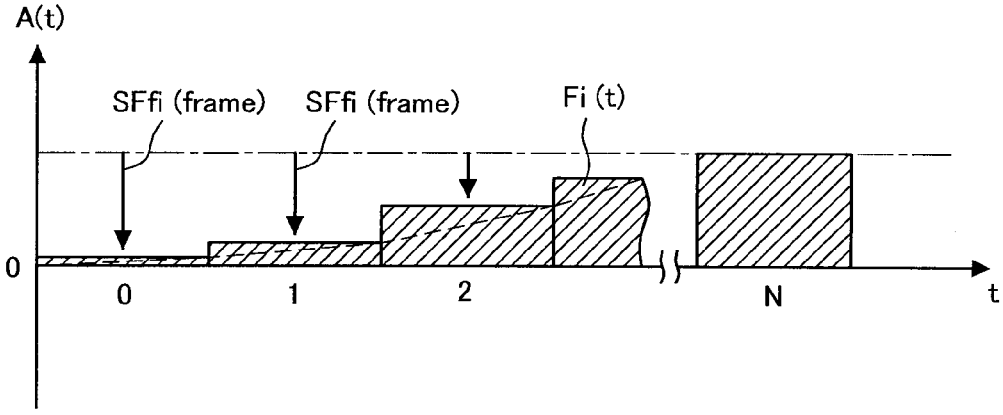
FIG. 15 is a diagram showing subtraction of normalization coefficient information which corresponds to a fade-in function.

First, in step S11 of FIG. 6, various initializations are performed. In the flow chart of FIG. 6, I is used as a counter for the number of gain control change points, and J is used as a counter for subframes. NGC is the number of gain control change points, and NS is the number of subframes. GL is a variable temporarily holding gain control change point location information Gloc. GM is the amplification amount of gain for the whole frame obtained by the process of the flow chart, and is initialized to 0. G is a variable of gain control level information that is used at the time of calculating the amplification amount GM of gain, and is initialized to 0.

After the initialization is performed in step S11, the loop process of step S12 through step S19 is performed for each subframe.

In step S12, it is decided whether or not value J of the subframe counter (location of subframe) matches the variable GL (gain control change point location information Gloc held therein), and when it is YES, that is, the value J of the subframe counter matches the gain control change point location, it proceeds to step S13, and the variable G of gain control level information in the current subframe is updated. When it is decided NO in step S12, it proceeds to step S17.

In step S13, the value obtained by subtracting 4 from gain control level information Glev[J] is assigned to the variable G of gain control level information (G=Glev[J]−4), and, further, the counter for the number of gain control change points is decremented (I=I−1).

After the process of step S13, the value of GL is updated according to I in step S14 through step S16.

That is, in step S14, it is decided whether or not I is 0 or more, and when it is YES, it proceeds to step S15 and gain control change point location information Gloc[I] corresponding to the decremented I is assigned to the variable GL, and it proceeds to step S17. When it is decided NO in step S14, GL is made −1 (GL=−1) in step S16, and it proceeds to step S17.

In step S17, gain control level information G of the current subframe is added to GM (GM=GM+G).

In the next step S18, the value J of the subframe counter is decremented (J=J−1), and it proceeds to step S19 to decide whether or not J is less than 0 (J<0). When it is NO, it returns to the above-described step S12, and when it is YES, the process is ended.

As described above, GM is updated for each subframe, and the amplification amount of gain for the whole frame is obtained.

The process is performed because it is necessary to modify gain control function generation information in consideration of the amplification amount of gain for the whole frame occurring due to cutoff amount of normalization coefficient information and inverse gain control.

Here, FIGS. 4A and 4B show the difference between the inverse gain functions due to the difference in gain control change point location information. The gain amplification amount within the frame is larger in FIG. 4B than in FIG. 4A.

This means that, in the gain control in the coding, the gain suppression amount has become large. In the case of the latter, normalization coefficient information becomes small, and accordingly, the cutoff amount of normalization coefficient information becomes large. In such a case, modification of gain control function information according to the cutoff amount of normalization coefficient information is unnecessary.

In such a manner, excessive amplification of gain can be prevented by appropriately modifying gain control function generation information according to the cutoff amount of normalization coefficient information.

In the embodiment of the present invention described above, a problem that arises, in a case of performing level adjustment of a signal without decoding a code string, due to the cutoff at the minimum value of normalization coefficient information after subtraction of normalization coefficient information and a solving method thereof have been described. On the other hand, a similar problem may arise in a case of amplifying a signal using an addition to normalization coefficient information.

FIGS. 7 and 8 are diagrams showing the problems in a case of amplifying a signal using an addition to normalization coefficient information. In the head frame, the result of addition to normalization coefficient information is 67, and a cutoff of 4 occurs. In such a case, when there is an attenuation of a signal by inverse gain control, a result that is a desired amplification of a signal by the addition of normalization coefficient information cannot be attained.

Also in such a case, by using a method similar to that of the embodiment of the present invention described above, excessive attenuation of gain can be prevented by appropriately modifying gain control function generation information.

Here, each step in the signal processing method according to the present invention described above can be provided as a program to be executed by a computer.

According to the embodiment of the present invention as described above, when directly processing a code string coded by a high efficiency coding method for audio that uses gain control and applying signal processing such as fade-in, fade-out or the like, it is possible to suppress the amplification of a signal occurred by the cutoff of normalization coefficient information and inverse gain control by appropriately rewriting gain control information according to the cutoff amount of normalization coefficient information, and to output a code string on which a desired signal processing has been performed.

Note that the present invention is not limited to the embodiment described above, and it is needless to say that various modifications are possible insofar as they are within the scope of the present invention.

What is claimed is:

1. A signal processing apparatus that performs signal processing on a code string obtained by dividing an input digital signal into blocks along the time axis, performing gain control on each block along the time axis, normalizing with a positive value a signal component on which the gain control has been performed, quantizing the normalized signal component, and coding and multiplexing along with gain control function generation information generating a gain control function for performing the gain control and normalization coefficient information, the signal processing apparatus comprising:

a hardware processor; and a memory coupled to the processor and storing a program that, when executed by the processor, causes the apparatus to perform a method, the method comprising:

adjusting a level of the signal by subtracting or adding an integer value from or to the normalization coefficient information in the code string;

calculating a cutoff amount for a case where the normalization coefficient information after subtraction or addition is cut off at a minimum or maximum possible value thereof because a subtracted or added amount of the normalization coefficient information is large; and modifying the gain control function generation information according to the calculated cutoff amount.

2. The signal processing apparatus according to claim 1, wherein the method comprises calculating the cutoff amount for a case where the subtracted amount of normalization coefficient information is larger than the normalization coefficient information and the normalization coefficient information after subtraction is cut off at the minimum possible value thereof.

3. The signal processing apparatus according to claim 1, wherein the method comprises calculating the cutoff amount for a case where the added amount of normalization coefficient information is large and the normalization coefficient information after addition is cut off at the maximum possible value thereof.

4. The signal processing apparatus according to claim 1, wherein the signal component on which the gain control is performed is a subband signal obtained by using a subband dividing filter on the input digital signal.

5. The signal processing apparatus according to claim 1, wherein the signal component which is normalized is an MDCT coefficient obtained by performing MDCT (Modified Discrete Cosine Transform) after performing the gain control.

6. The signal processing apparatus according to claim 5, wherein the normalizing is performed on each of a plurality of the MDCT coefficients, and a plurality of pieces of the normalization coefficient information are obtained as an output of the normalizing.

7. The signal processing apparatus according to claim 1, wherein the gain control function generation information is modified only when the code string includes the gain control function generation information.

8. A signal processing method of a signal processing apparatus that performs signal processing on a code string obtained by dividing an input digital signal into blocks along the time axis, performing gain control on each block along the time axis, normalizing with a positive value a signal component on which the gain control has been performed, quantizing the normalized signal component, and coding and multiplexing along with gain control function generation information on generating a gain control function for performing the gain control and normalization coefficient information, the signal processing method comprising the steps of:

adjusting a level of the signal by adding or subtracting an integer value to or from the normalization coefficient information in the code string;

calculating, by the apparatus, a cutoff amount for a case where the normalization coefficient information after subtraction is cut off at a minimum possible value thereof because a subtracted amount of the normalization coefficient is larger than the normalization coefficient information; and modifying, by the apparatus, gain control function generation information according to the calculated cutoff amount.

9. The signal processing method according to claim 8, further comprising the step of calculating a cutoff amount for a case where the normalization coefficient information after addition is cut off at a maximum possible value thereof because an added amount of the normalization coefficient is large.

10. A non-transitory, computer-readable storage medium storing a program that, when executed by a computer, causes the computer to perform a process on a code string obtained by dividing an input digital signal into blocks along the time axis, performing gain control on each block along the time axis, normalizing with a positive value a signal component on which the gain control has been performed, quantizing the normalized signal component, coding and multiplexing along with gain control function generation information on generating a gain control function for performing the gain control and normalization coefficient information, the process comprising the steps of:

adjusting a level of the signal by adding or subtracting an integer value to or from the normalization coefficient information in the code string;

calculating a cutoff amount for a case where the normalization coefficient information after subtraction is cut off at a minimum possible value thereof because a subtracted amount of the normalization coefficient is larger than the normalization coefficient information; and modifying gain control function generation information according to the calculated cutoff amount.

* * * * *